US006879310B2

(12) United States Patent
Nose

(10) Patent No.: US 6,879,310 B2
(45) Date of Patent: Apr. 12, 2005

(54) LIQUID CRYSTAL DISPLAY AND METHOD FOR DRIVING THE SAME

(75) Inventor: Takashi Nose, Tokyo (JP)

(73) Assignee: NEC Electronics Corporation, Kanagawa (JP)

( * ) Notice: Subject to any disclaimer, the term of this patent is extended or adjusted under 35 U.S.C. 154(b) by 523 days.

(21) Appl. No.: 10/138,696

(22) Filed: May 6, 2002

(65) Prior Publication Data

US 2002/0163490 A1 Nov. 7, 2002

(30) Foreign Application Priority Data

May 7, 2001 (JP) ..... 2001-136740

(51) Int. Cl.[7] ..... G09G 3/36

(52) U.S. Cl. ..... 345/88; 345/98; 345/94; 345/89

(58) Field of Search ..... 345/87, 88, 89, 345/94, 98, 99, 101

(56) References Cited

U.S. PATENT DOCUMENTS 5,933,199 A * 8/1999 Yoon ..... 348/674
6,275,207 B1 * 8/2001 Nitta et al. ..... 345/89
6,462,735 B2 * 10/2002 Naito ..... 345/87
6,483,496 B2 * 11/2002 Kobayashi et al. ..... 345/98
6,795,063 B2 * 9/2004 Endo et al. ..... 345/87

* cited by examiner

*Primary Examiner*—Kent Chang
(74) *Attorney, Agent, or Firm*—McGinn & Gibb, PLLC

(57) ABSTRACT

A liquid crystal display and its driving method are provided which enable a proper gamma correction to be made to each of red, green, and blue colors without causing a decrease in a number of gray levels in an output image and enable lowering in an image quality to be prevented. The liquid crystal display includes a liquid crystal panel in which pixel electrodes for each of the red, green, and blue colors are repeatedly arranged along a scanning line, a scanning line driving circuit to scan in every scanning period, an RGB (Red, Green, and Blue) switching reference gray-scale voltage producing circuit to produce a reference voltage corresponding to a voltage-transmittance characteristic of each color, and a signal line driving circuit to produce a signal voltage and to feed to each signal line.

9 Claims, 14 Drawing Sheets

LIQUID CRYSTAL DISPLAY AND METHOD FOR DRIVING THE SAME

BACKGROUND OF THE INVENTION

1. Field of the Invention

The present invention relates to an image display device and more particularly to a liquid crystal display (LCD) and its driving method in which an image signal to be fed to a liquid crystal panel is produced using a reference gray-scale voltage and gray-scale data.

The present application claims priority of Japanese Patent Application No. 2001-136740 filed on May 7, 2001, which is hereby incorporated by reference.

2. Description of the Related Art

In an LCD, display of an image is performed by using a liquid crystal panel as a display device. The liquid crystal panel is so configured that a first glass substrate on which a pixel electrode made up of a transparent electrode is placed in a manner to correspond to pixels arranged in a matrix form on a display surface faces a second glass substrate on which a common electrode made up of a transparent electrode with a liquid crystal substance being a crystalline liquid that provides optical anisotropy produced by an electric field put between the first and second glass substrates in a hermetically sealed manner, and polarizers whose polarizing planes intersect each other at right angles are mounted on both the glass substrates. Light and shade are displayed for every pixel by driving the pixel electrode from a row direction of and from a column direction on a panel screen, thereby changing a degree of optical anisotropy of the liquid crystal substance on the pixel electrode and changing transmittance of light which further changes luminance of transmissive-light emitted from a backlight being mounted on a rear surface. Moreover, color display is performed by arranging the pixel electrode of each pixel for each of three primary colors made up of red (R), green (G), and blue (B) color and by mounting, on the second glass substrate, a color filter for each of the pixel electrodes arranged for each of the R, G, and B colors and by driving the pixel electrode in row and column directions so that electric power being different for every color is applied thereto.

In this case, an image signal output from an image writing device such as a personal computer is made up of gray-scale data in which a level of brightness of an image is displayed on a logarithmic axis at equal intervals, for example, 64 shades of gray scale are represented by 6 bits of a digital signal. In an LCD, display of an image is performed by applying a voltage that changes according to gray-scale data to a liquid crystal panel, however, since a gamma ($\gamma$) characteristic value exhibiting a relation between a change in applied voltage and a change in luminance is ordinarily set to be about 2.2, the LCD has to be so configured that processing ($\gamma$ correction) can be performed in a manner that a voltage to be applied corresponding to a gamma ($\gamma$) characteristic is produced from the gray-scale data. Moreover, in a normally white-type liquid crystal panel, since its transmittance is highest in a state where an applied voltage is not applied and the higher the applied voltage becomes the smaller the transmittance becomes, setting is made so that the applied voltage becomes smaller as the gray-scale date increases.

Next, configurations and operations of a conventional LCD will be described below. FIG. 10 is a schematic block diagram showing a first example of the conventional LCD.

FIG. 11 is a schematic block diagram showing an example of configurations of a reference gray-scale voltage producing circuit and a signal line driving circuit employed in the conventional LCD. FIG. 12 is a diagram illustrating a gray-scale data input for the conventional LCD. FIG. 13 is a diagram showing an example of gamma characteristics in a liquid crystal panel of the conventional LCD.

The conventional LCD 11 shown as the first conventional example in FIG. 10, chiefly includes a liquid crystal panel 12, a display control circuit 13, a reference gray-scale voltage producing circuit 14, a scanning line driving circuit 15, and a signal line driving circuit 16. The liquid crystal panel 12, as described above, is so configured that wirings serving as a plurality of scanning lines 121 are mounted in a horizontal direction relative to a display surface and wirings serving as a plurality of signal lines 122 are mounted in a vertical direction relative to the display surface, wherein a pixel electrode 123 is formed at each point of intersection of each of the scanning lines 121 and each of the signal lines 122 and a TFT (Thin Film Transistor) 124 is connected between each of the pixel electrodes 123 and each of the signal lines 122 corresponding to each of the pixel electrodes 123 and a gate of each of the TFTs 124 is connected to each of the scanning lines 121. In this case, as shown in FIG. 10, one screen is so constructed that a pixel electrode 123 for a red (R) color, a pixel electrode 123 for a green (G) color, and a pixel electrode 123 for a blue (B) color each being connected through the TFT 124 to the scanning line 121 and to the signal line 122 and each being arranged in order in a horizontal direction in which a specified number of sets each being made up of the above three pixel electrodes 123 are arranged and these three pixel electrodes 123 make up one color pixel, while specified pieces of the pixel electrodes 123 for a same color each being connected through the TFT 124 to the signal line 122 and to the scanning line 121 are arranged in a vertical direction.

The display control circuit 13 transmits gray-scale data having been received from an image writing device 100 and being made up of data for a gray-scale for the R, G, and B colors so as to correspond to an arrangement of the pixel electrodes 123 in the liquid crystal panel 12 and a signal line control signal, in accordance with synchronizing data also having received from the image writing device 100 and in every scanning period, to the signal line driving circuit 16 and also transmits a scanning line control signal, in accordance with the synchronizing data, to the scanning line driving circuit 15.

The reference gray-scale voltage producing circuit 14 produces a reference gray-scale voltage required when the signal line driving circuit 16 outputs a signal having a voltage corresponding to gray-scale data to each of the signal lines 122. The scanning line driving circuit 15 outputs a scanning signal to each of the scanning lines 121 for every one field in response to a scanning line control signal. The signal line driving circuit 16 produces, in every scanning period and in response to a signal line control signal, a signal having undergone a gamma ($\gamma$) correction based on a voltage-transmittance characteristic, according to gray-scale data which has been fed from the display control circuit 13 and has been sorted and according to a reference gray-scale voltage fed from the reference gray-scale voltage producing circuit 14 and outputs the signal to each of the signal lines 122.

Moreover, each of the reference gray-scale voltage producing circuit 14 and the signal line driving circuit 16 has configurations shown in FIG. 11. FIG. 11 shows an example in which voltages corresponding to the gray-scale data are output to 1920 pieces of the pixel electrodes 123 corresponding to 640 pieces of color pixels arranged in a horizontal direction in a liquid crystal panel 12. The reference gray-scale voltage producing circuit 14 outputs a voltage obtained by dividing the reference voltage $V_{REF}$ using a voltage dividing circuit made up of resistors R1, R2, R3, . . . , R9, R10, and R11 through voltage followers B1, B2, . . . , B9, and B10 to the signal line driving circuit 16 as reference gray-scale voltages V0, V1, . . . , V8, and V9. In the signal line driving circuit 16, an MPX (multiplexer) 161, based on a polarity reversing pulses POL used to drive the liquid crystal panel 12 with alternating current, divides reference gray-scale voltages V0 to V9 into a set of reference gray-scale voltages V0 to V4 and a set of reference gray-scale voltages V5 to V9 and then outputs the divided voltages to a DAC (digital-analog converter) 162.

Moreover, for example, 6 bits of R-color gray-scale data DR, 6 bits of G-color gray-scale data DG, and 6-bits of B-color gray-scale data DB all being fed from the display control circuit 13 are held, in parallel, in a data register section 164 being controlled by an output, which is controlled by a horizontal start pulse HSP and a clock signal HCK, fed at each stage in a shift register section 163. The above gray-scale data DR, DG, and DB being held in parallel in the data register section 164 are transferred collectively to a latch section 165 by a latch signal STB and then are latched therein. Furthermore, gray-scale data output from the latch section 165 are level-shifted through a level shift section 166 and are transferred to the DAC 162.

The gray-scale data having been transferred to the DAC 162 undergoes the gamma correction, based on the set of the reference gray-scale voltages V0 to V4 and the set of the reference gray-scale voltages V5 to V9 all being fed from the MPX 161 and then produces a D-A (digital to analog) converted signal voltage and are output through the voltage followers F1, F2, . . . , F1919, and F1920 to each of corresponding signal lines 122.

Next, operations of the LCD 11 of the first conventional example will be described by referring to FIG. 10 to FIG. 12. FIG. 12 shows a state of input of gray-scale data fed to the LCD 11 from the image writing device 100 such as a personal computer. In this example, the liquid crystal panel 12 has 640 pieces of color pixels in a horizontal direction. Also, it shows a state in which signals made up of gray-scale data containing each set of the R, G, and B colors which is parenthesized in every scanning period being repeated 640 times are input 480 times corresponding to positions of 480 pieces of the scanning lines 121 arranged in a vertical direction in the liquid crystal panel 12. The gray-scale data for each color corresponds to a number of gray-scales in an image to be displayed, for example, 64 shades of gray is expressed by 6 bits of a digital signal. Moreover, the image writing device 100 outputs a vertical sync signal as synchronizing data in a manner that it corresponds to a display period in each field and a horizontal sync signal as the synchronizing data in a manner that it corresponds to a scanning period in each line.

The display control circuit 13 outputs gray-scale data which have been input from the image writing device 100 to the signal line driving circuit 16 according to synchronizing data in every scanning period and by data for ore scanning line 121 and a scanning line control signal to the scanning line driving circuit 15 according to the synchronizing data and a signal line control signal to the signal line driving circuit 16.

This causes the scanning line driving circuit 15 to sequentially output, according to a scanning line control signal, a scanning signal which forms one field of a screen to each of the scanning lines 121 for every vertical sync signal and therefore the TFT 124 being connected to each of the scanning lines 121 is turned ON, thus allowing a signal voltage to be applied from each of the signal lines 122 to each of the pixel electrodes 123 being connected to the scanning line 121.

Moreover, the signal line driving circuit 16 makes a gamma correction to the gray-scale data for each of the R, G, and B colors by using a reference gray-scale voltage fed from the reference gray-scale voltage producing circuit 14 so that a V-T (voltage-transmittance) characteristic value in the liquid crystal panel 12 becomes a specified gamma value and outputs a voltage corresponding to a gamma-corrected V-T characteristic value to each of the signal lines 122.

Thus, in the conventional LCD shown in FIG. 10, a signal voltage is produced presuming that a voltage used for making the gamma correction to gray-scale data for each of the R, G, and B colors is same and a V-T characteristic for each of the R, G, and B colors in the liquid crystal panel 12 is also same. However, in an actual operation of the conventional LCD 11, the V-T characteristic is different in each of the R, G, and B colors, based on luminance of a backlight, transmittance of a color filter, a difference in a characteristic of a liquid crystal or a like and therefore a gamma characteristic of an image to be displayed is made different in each of the R, G, and B colors, which causes a change in gradation in color and, as a result, a decrease in an image quality. FIG. 13 illustrates a change in the gamma characteristic for each of colors to be displayed, in the case of 64 gray-scale display, showing that the transmittance for a same gray-scale value is small (that is, the gamma value is large) in order of the G color, B color and R color.

To solve these problems, in the conventional LCD 11, a method in which data is processed in advance on a side of the image writing device and gray-scale data to which a correction has been made to compensate for such differences in the gamma characteristic as described above is output, a method in which a circuit is mounted on an input side of the LCD, which makes a gamma correction to input data by each of the R, G, and B colors, or a like are employed.

Next, another LCD as a second conventional example in which a gamma correction is made to gray-scale data on an input side is described below. FIG. 14 is a schematic block diagram showing configurations of another LCD 11A as a second conventional example. FIG. 15 is a diagram illustrating an increase in a number of gray-scales based on a gamma correction in the LCD 11A of the second conventional example.

The LCD 11A of the second conventional example, as shown in FIG. 14, chiefly includes a liquid crystal panel 12, a display control circuit 13, a reference gray-scale voltage producing circuit 14, a scanning line driving circuit 15, a signal line driving circuit 16, and an image processing circuit 17. Configurations and functions of the liquid crystal panel 12, display control circuit 13, reference gray-scale voltage producing circuit 14, scanning line control signal 15, and signal line driving circuit 16 are same as those in the first conventional example shown in FIG. 10.

The image processing circuit 17 is made up of a chip having a look-up table (LUT) for an R color signal (not shown), a look-up table (LUT) for a G color signal (not shown), and a look-up table (LUT) for a B color signal (not shown) and, by reading gray-scale data, which corresponds to each of input gray-scale data for each of the R, G, and B colors, contained in each of the look-up tables for the R, G and B color signals, performs a gamma correction to each of the R, G, and B colors and then outputs gray-scale data obtained after the gamma correction to the display control circuit 13.

Next, operations of the LCD 11A of the second conventional example will be explained by referring to FIGS. 14 and 15. The gray-scale data output from an image writing device 100 made up of a personal computer or a like is arranged in a manner as shown in FIG. 12 and, for example, 64 shades of gray are expressed by 6 bits of digitalized image signal for each of the R, G, and B colors. The image processing circuit 17 inputs gray-scale data input for each of the R, G, and B colors to the each of the LUTs for the R, G, B colors and reads gray-scale data corresponding to each of the R, G, and B colors from the LUTs for each of the R, G, B colors to display gray-scale data obtained after the gamma correction and to output them to the display control circuit 13.

The display control circuit 13, as in the case of the first conventional example, outputs gray-scale data obtained after the gamma correction in every scanning period in a manner that the gamma-corrected gray-scale data corresponds to a position of each of the scanning lines 121, to the signal line driving circuit 16 and, at the same time, outputs a scanning line control signal to the scanning line driving circuit 15 and a signal line control signal to the signal line driving circuit 16. The reference gray-scale voltage producing circuit 14, as in the case of the first conventional example, outputs a reference gray-scale voltage so that a V-T characteristic value in the liquid crystal panel 12 becomes a specified gamma value. At this point, as explained in the above first conventional example, the reference gray-scale voltage is same in each of the R, G, and B colors.

The signal line driving circuit 16 generates an output voltage corresponding to input gray-scale data obtained after the gamma correction to be produced by a DAC mounted in the signal line driving circuit 16 using a reference gray-scale voltage fed from the reference gray-scale voltage producing circuit 14 and outputs it to each of the signal lines 122.

As described above, in the conventional LCD 11A shown in FIG. 14, by performing data processing on gray-scale data being an original image signal, a gamma correction is made in every color. However, if the gamma correction is made, by data processing, to input gray-data, a number of gray levels in the gray-scale data obtained after the gamma correction becomes small. This is because the input gray-scale data is so constructed that, for example, in the case of 64 shades of gray, 64 pieces of gray-scale values correspond to 6 bits of digital data in a one-to-one relationship, however, if the corresponding relationship is changed between input data and output data by data processing in the 6 bits of digital data, a digital value being skipped in reading occurs in the output data and, as a result, gray-scale data corresponding to the digital value having been skipped in reading is not output.

Thus, in the case of the gamma correction by data processing, only gray-scale data that provides direct correspondence between input data and output data is taken out and is used and therefore all the gray-scale values contained in the gray-scale data on a side of input cannot be fully used, which causes lower quality of an image caused by a decrease in a number of gray levels in an output image.

FIG. 15 is a diagram illustrating an decrease in a number of gray levels based on a gamma correction in the LCD of the second conventional example and data conversion to gray-scale data made up of, for example, 64 gray levels is performed by following equation:

$$Dout = INT\{64 \times (Din/64)\hat{}(1/\gamma d)\} \quad (1)$$

where "Din" denotes input gray-scale data, "Dout" denotes output gray-scale data, "γd" denotes a gamma-corrected value by data processing, "INT" denotes a symbol to make values be an integer, and "^" denotes a power. In FIG. 15, the number of gray levels that can be displayed at each of the "γd" values is shown. If γd=1, since input gray-scale data matches the output gray-scale data, no change in the number of gray levels occurs. However, if γd<1 or γd>1, the number of gray levels in an output image decreases.

In each of the conventional LCDs 11 and 11A, same reference gray-scale voltage which is produced by the reference gray-scale voltage producing circuit 14 is used for each of the R, G, and B colors. The correction corresponding to a difference in a gamma characteristic for each of the R, G, and B colors in the liquid crystal panel 12 is performed by data processing to input gray-scale data.

However, in the method in which correction of a gamma characteristic is made by data processing to gray-scale data, as described above, only a portion in which input gray-scale data directly corresponds to output gray-scale data is taken out for use, all the gray-scale data contained in an image signal cannot be used, which causes a decrease in the number of gray levels in an output image after processing of the gamma correction and lowering in an image quality to be displayed.

SUMMARY OF THE INVENTION

In view of the above, it is an object of the present invention to provide an LCD and its driving method which enables a proper gamma correction to be made to each of R, G, and B colors without causing a decrease in a number of gray levels in an output image.

According to a first aspect of the present invention, there is provided a liquid crystal display including:

a liquid crystal panel in which pixel electrodes for each of red, green, and blue colors are arranged sequentially and repeatedly on a screen along a scanning line on a same row;

a scanning line driving unit to sequentially perform scanning along the scanning line on each row in every scanning period;

a reference gray-scale voltage producing unit to produce a reference gray-scale voltage which corresponds to a voltage-transmittance characteristic curve for each of the red, green, and blue colors to be displayed in the liquid crystal panel at every time of scanning along the scanning line for each of the red, green, and blue colors; and a signal line driving unit to make a gamma correction to input gray-scale data corresponding to each color by using the reference gray-scale voltage for each of the red, green, and blue colors and to produce a signal voltage and then to feed the produced signal voltage to a signal line on a column corresponding to the pixel electrode for each of the red, green, and blue colors.

In the foregoing, a preferable mode is on wherein the input gray-scale data is obtained by sorting outside gray-scale data in which gray-scale data for each of the red, green, and blue colors is arranged along the signal line on each column and is transmitted sequentially and repeatedly for every scanning line by a display control unit so that gray-scale data for each of the red, green, and blue colors is arranged along the same scanning line and is transmitted sequentially and repeatedly for every scanning line.

Also, a preferable mode is one wherein the reference gray-scale voltage producing unit has a voltage dividing unit for each of the red, green, and blue colors to divide a reference voltage and produces a voltage used to make a gamma correction so as to correspond to a voltage-transmittance characteristic of each of the red, green, and blue colors in the liquid crystal panel from the voltage dividing unit for each of the red, green, and blue colors and outputs the produced voltage as the reference gray-scale voltage for each of the red, green, and blue colors at every scanning along each scanning line for each of the red, green, and blue colors.

Also, a preferable mode is one wherein the reference gray-scale voltage producing unit changes a reference gray-scale voltage for each of the red, green, and blue colors according to image quality data of an input image.

Also, a preferable mode is one wherein the reference gray-scale voltage producing unit has a digital-analog converting section for each of the red, green, and blue colors to perform a digital-analog conversion on image quality data exhibiting a gamma characteristic of an input image and to generate a reference gray-scale voltage in which a change in gamma characteristics of the input image has been compensated for and a selecting section to select the reference gray-scale voltage for each of the red, green, and blue colors generated by the digital-analog converting section at every scanning performed on the scanning line for each of the red, green, and blue color and to output the selected reference gray-scale voltage.

Also, a preferable mode is one that wherein includes an image processing unit to obtain output gray-scale data from input gray-scale data, and wherein the reference gray-scale voltage producing unit produces a reference gray-scale voltage for each of the red, green, and blue colors so as to correspond to a gamma value at a plurality of gray-scale voltage converting points within a range in which the gamma correction is made possible and wherein the signal line driving unit makes a gamma correction to input gray-scale data using the reference gray-scale voltage at the gray-scale voltage converting point and makes the gamma correction, in the case of a gamma value at an intermediate point between the gray-scale voltage converting points being adjacent to each other, to the input gray-scale data according to output gray-scale data obtained by the image processing unit from input gray-scale data based on a relation between a gamma value at the gray-scale voltage converting points being nearest to a gamma value at the intermediate point and the gamma value at the intermediate point by using the reference gray-scale voltage at the gray-scale voltage converting point.

According to a second aspect of the present invention, there is provided a method for driving a liquid crystal display having a liquid crystal panel in which pixel electrodes for each of red, green, and blue colors are arranged sequentially and repeatedly in a manner so as to correspond to each of scanning lines on a same row, the method including:

a step of scanning along each of the scanning lines on each row in every scanning period;

a step of producing a reference gray-scale voltage corresponding to a voltage-transmittance characteristic of each of the red, green, and blue colors of the liquid crystal panel at every scanning along the signal line for each of the red, green, and blue colors;

a step of making a gamma correction to input gray-scale data corresponding to each of the red, green, and blue colors by using the reference gray-scale voltage for each of the red, green, and blue colors and producing a signal voltage; and a step of feeding the signal voltage to a signal line on each column corresponding to a pixel electrode of each of the red, green, and blue colors in every scanning period.

In the foregoing, a preferable mode is one wherein the reference gray-scale voltage of each of the red, green, and blue colors is changed according to image quality data of an input image.

Also, a preferable mode is one that wherein includes:

a step of producing a reference gray-scale voltage of each of the red, green, and blue colors corresponding to a gamma value at a plurality of gray-scale voltage converting points in a range in which a gamma correction is made possible;

a step of making the gamma correction to input gray-scale data by using the reference gray-scale voltage at the gray-scale voltage converting points; and a step of making the gamma correction to input gray-scale data, in the case of a gamma value at an intermediate point between the gray-scale voltage converting points being adjacent to each other by using the reference gray-scale voltage at the gray-scale voltage converting points according to output gray-scale data obtained from the input gray-scale data based on a relation between a gamma value at the gray-scale voltage converting point being nearest to the gamma value at the intermediate point and the gamma value at the intermediate point.

With the above configurations, by arranging pixels for each of R, G, and B colors so that pixels in a same color are placed in a scanning direction and by using a different reference gray-scale voltage for each of the R color, G color and B color, since a signal line voltage being matched with a V-T characteristic being different in each of the R, G, and B colors of a liquid crystal panel can be provided, a decrease in a number of gray levels in an output image caused by gamma correction processing can be avoided and lowering in an image quality can be prevented.

With another configuration as above, since image quality data (gamma characteristic for each of the R, G, and B colors) is received and a gamma correction is made to an input image, a change in a relation of the gamma characteristic between the input image and the LCD can be compensated for and therefore lowering in an image quality can be prevented without causing a decrease in the number of gray levels in an output image.

With still another configuration as above, since a gamma correction is made using a reference gray-scale voltage to comparatively a few gray-scale voltage converting points in a wide range in which the gamma correction is made and the gamma correction is made using a gamma value obtained by performing gray-scale data processing from a gamma value at a nearest point in a region between gray-scale voltage converting points, the gamma correction can be made without a decrease in the number of gray levels in an output image using a simple configuration.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings.

First Embodiment

Figure 1:
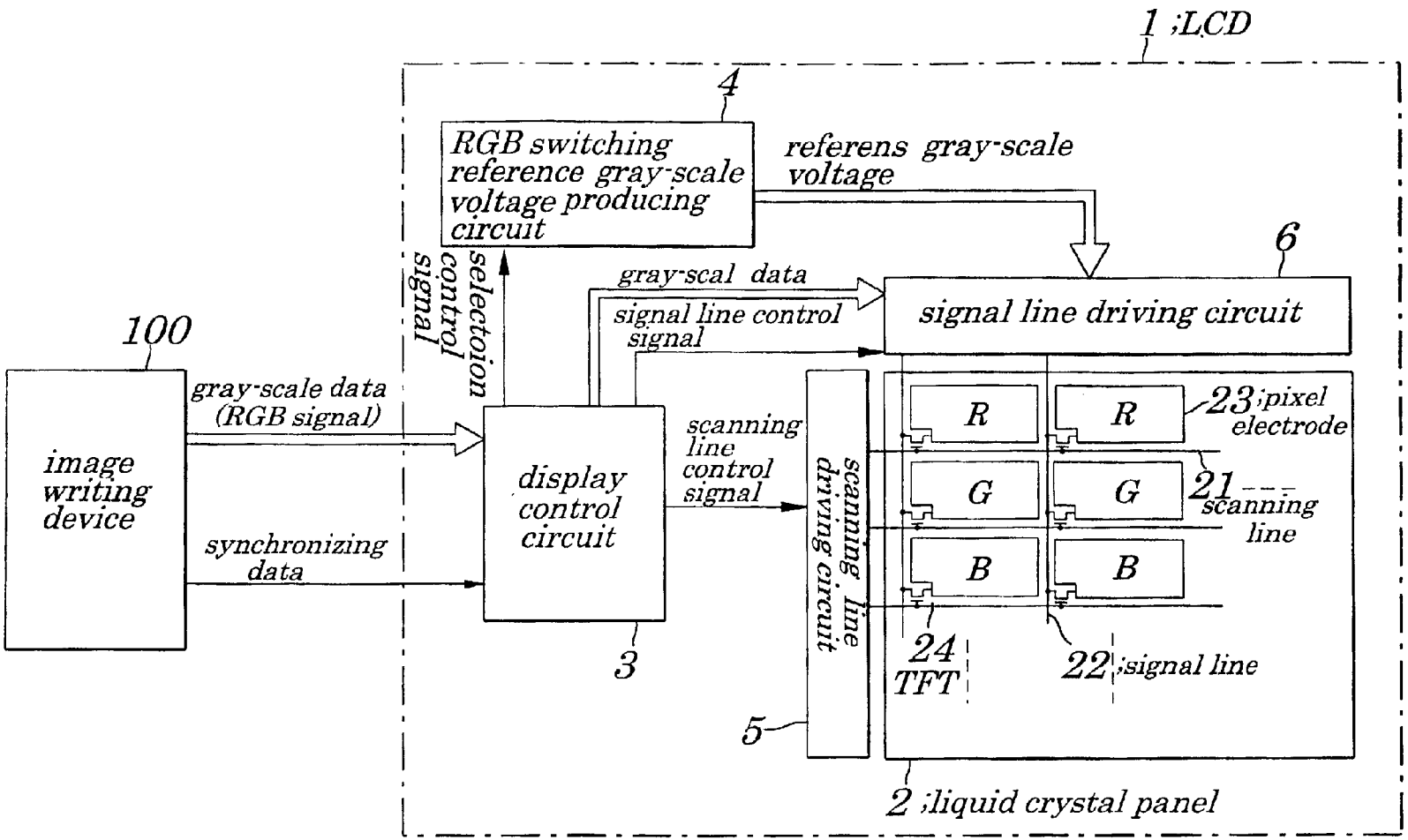
FIG. 1 is a schematic block diagram showing configurations of an LCD according to a first embodiment of the present invention.
Figure 2:
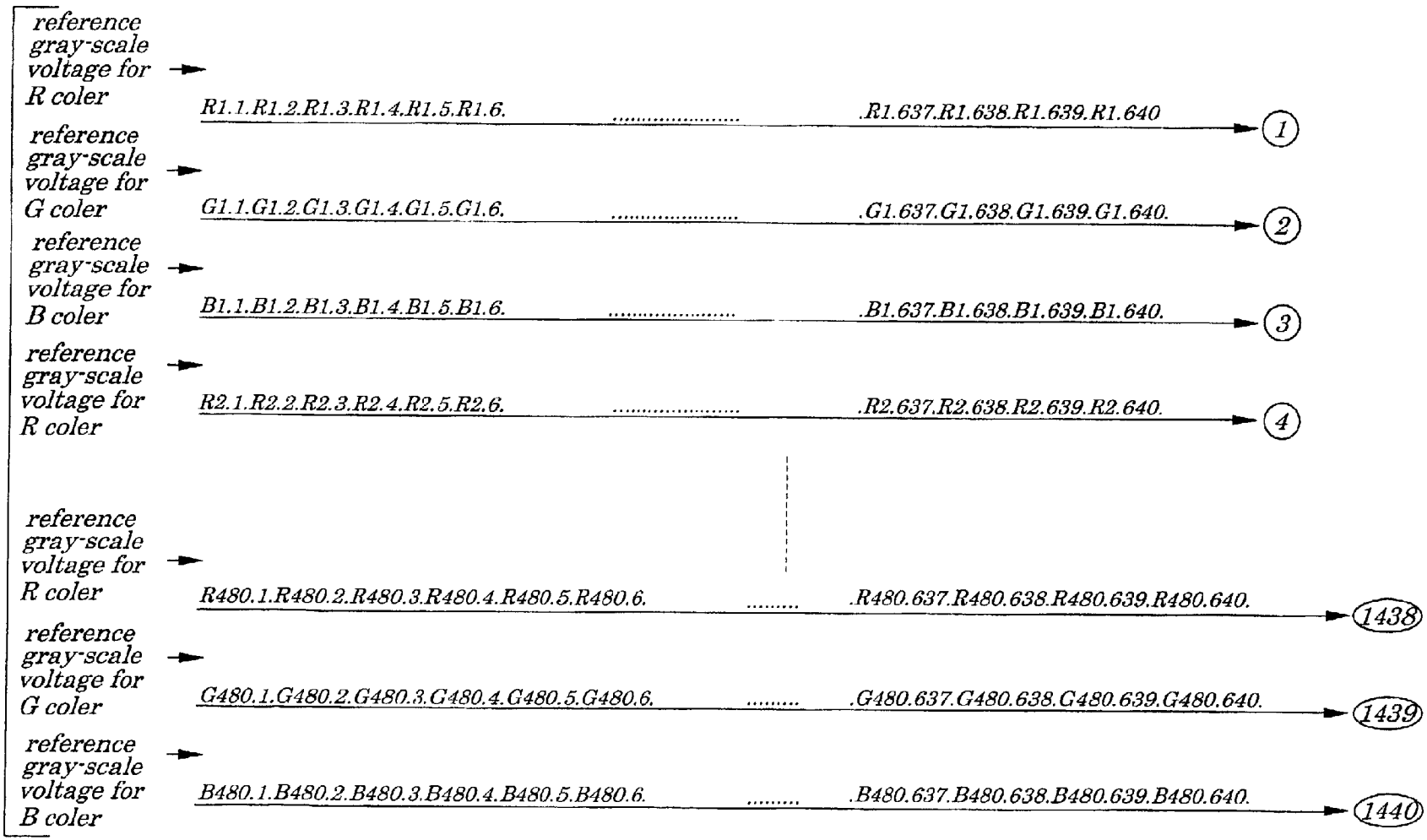
FIG. 2 is a diagram illustrating a sorted state of gray-scale data according to the first embodiment of the present invention.
Figure 3:
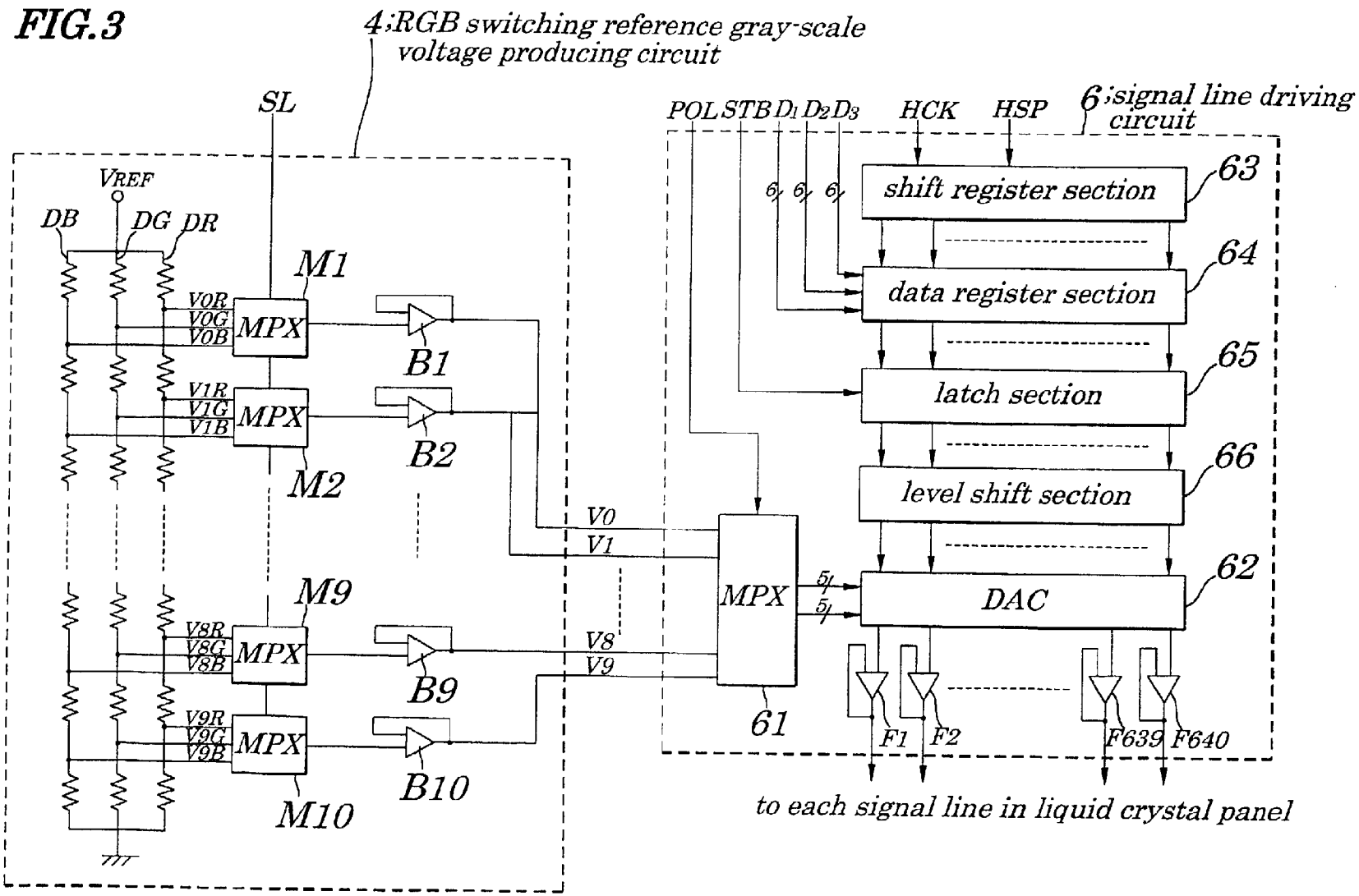
FIG. 3 is a schematic block diagram showing a concrete example of configurations of a reference gray-scale voltage producing circuit and a signal line driving circuit according to the first embodiment of the present invention.
Figure 4:
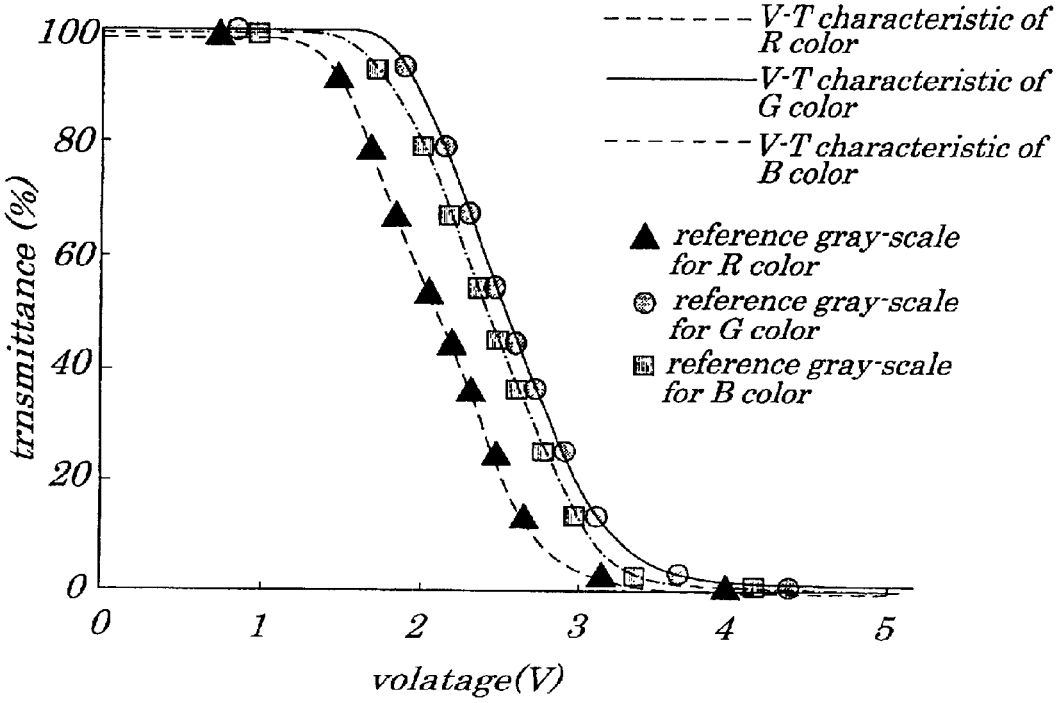
FIG. 4 is a diagram illustrating a reference gray-scale voltage for each color employed in the first embodiment of the present invention.
Figure 5:
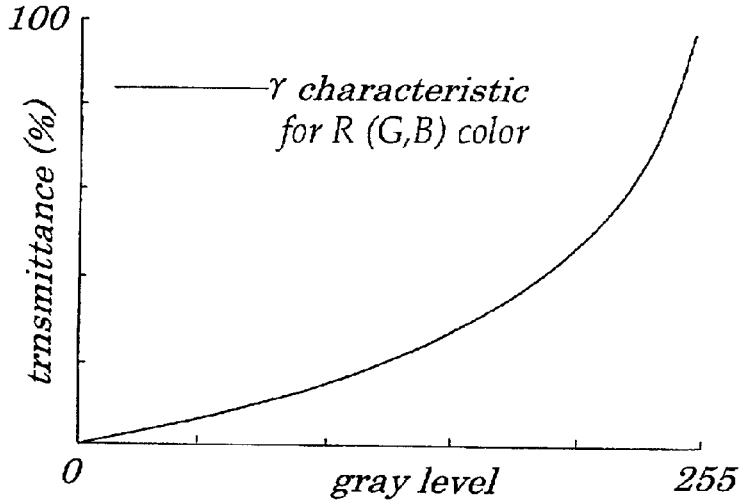
FIG. 5 is a diagram illustrating a gamma characteristic of each color employed in the first embodiment of the present invention.

FIG. 1 is a schematic block diagram showing configurations of an LCD of a first embodiment of the present invention. FIG. 2 is a diagram illustrating a sorted state of gray-scale data according to the first embodiment. FIG. 3 is a schematic block diagram showing a concrete example of configurations of an RGB switching reference gray-scale voltage producing circuit 4 and a signal line driving circuit 6 of the first embodiment. FIG. 4 is a diagram illustrating a reference gray-scale voltage for each color employed in the first embodiment. FIG. 5 is a diagram illustrating a gamma characteristic of each color employed in the first embodiment.

The LCD 1 of the first embodiment chiefly includes a liquid crystal panel 2, a display control circuit 3, an RGB (Red, Green, and Blue) switching reference gray-scale voltage producing circuit 4, a scanning line driving circuit 5 and a signal line driving circuit 6.

Configurations of the liquid crystal panel 2 are same as those of the conventional one in that wirings serving as a plurality of scanning lines 21 are mounted in a horizontal direction relative to a display surface and wirings serving as a plurality of signal lines 22 are mounted in a vertical direction relative to the display surface, wherein a pixel electrode 23 is formed at each point of intersection of each of the scanning lines 21 and each of the signal lines 22 and a TFT 24 is connected between each of the pixel electrodes 23 and each of the signal lines 22 corresponding to each of the pixel electrodes 23 and a gate of each of the TFTs 24 is connected to each of the scanning lines 21, however, differ from those of the conventional one in that, as shown in FIG. 1, a pixel electrode 23 for an R (Red) color, a pixel electrode 23 for a G (Green) color, and a pixel electrode 23 for a B (Blue) color are arranged in order in a vertical direction and each of them is connected to the same signal line 22, which makes up one color pixel, and a specified number of such pixel electrodes 23 for the R, G, and B colors are arranged in the vertical direction, while a specified number of pixel electrodes 23 for same color are arranged in a horizontal direction and each of them is connected to a same scanning line 21 and these pixel electrodes 23 arranged in vertical and horizontal directions make up one screen. Therefore, if configurations of the pixel in one screen are same, a number of the signal lines 22 in the liquid crystal panel 2 is one third the number of signal lines 122 in the conventional liquid crystal panel 12 and the number of the scanning lines 21 are larger by three times than that in the conventional liquid crystal panel 122.

The display control circuit 3 receives gray-scale data in which gray-scale data for the R, G, and B colors are repeatedly arranged from an image writing device 100 and sorts the input gray-scale data according to synchronizing data for every scanning line 21 so that the gray-scale data correspond to pixels arranged in the liquid crystal panel 2 and, at the same time, outputs a scanning line control signal to the scanning line driving circuit 5 and a signal line control signal to the signal line driving circuit 6.

The RGB switching reference gray-scale voltage producing circuit 4 produces three kinds of reference gray-scale voltages including a reference gray-scale voltage for the R color, a reference gray-scale voltage for the G color, and a reference gray-scale voltage for the B color each matching a V-T characteristic of each of the R, G, and B colors in the liquid crystal panel 2, required when a signal having a voltage corresponding to gray-scale data is output by the signal line driving circuit 6.

The scanning line driving circuit 5 outputs a scanning signal in every field period according to a scanning line control signal to each of the scanning lines 21.

The signal line driving circuit 6 produces a signal, which has undergone a gamma correction according to the V-T characteristic of each color in the liquid crystal panel 2, in accordance to a signal line control signal in every scanning period based on sorted gray-scale data fed from the display control circuit 3 and on the three kinds of the reference gray-scale voltages fed from the RGB switching reference gray-scale voltage producing circuit 4 and then outputs it to each of the signal lines 22.

The sorting of gray-scale data in the display control circuit 3 is performed in a way as shown in FIG. 2. FIG. 2 shows an example in the case of a video graphics array (VGA) (640×RGB×480 pixels). The gray-scale data input from the image writing device 100, as shown in FIG. 2, is made up of signals in which a set of gray-scale data being arranged in order of R, G, and B colors is repeatedly arranged from a pixel 1 to a pixel 640 in every scanning line position, which is input in a manner that it corresponds to each of scanning line positions 1 to 480. The display control circuit 3 sorts the input gray-scale data in a manner as shown in FIG. 2 and outputs, sequentially and repeatedly, signals in which signals for the R color are arranged from the pixel 1 to the pixel 640, signals in which signals for the G color are arranged from the pixel 1 to the 640 pixels, and signals in which signals for the B color are arranged from the pixel 1 to the pixel 640 in every scanning line position to each of the scanning line positions 1 to 1440. At this point, a reference gray-scale voltage for the R color, a reference gray-scale voltage for the G color, and a reference gray-scale voltage for the B color are fed by the RGB switching reference gray-scale voltage producing circuit 4 respectively to the scanning line position for the R color, scanning line position for the G color, and scanning line position for the B color.

Moreover, each of the RGB switching reference gray-scale voltage producing circuit 4 and the signal line driving circuit 6 has configurations as shown in FIG. 3.

In the RGB switching reference gray-scale voltage producing circuit 4, voltages obtained by selecting from voltages V0R, V0G, V0B, . . . , V9R, V9G, and V9B which are obtained by dividing a reference voltage $V_{REF}$ using a voltage dividing circuit for a R color (DR), a voltage dividing circuit for a G color (DG), and a voltage dividing circuit for a B color (DB), respectively, for every color of the R. G, and B colors in accordance with a selection control signal SL using MPXs (multiplexers) M1, M2, . . . , M9, and M10, are output, through voltage followers B1, B2, . . . , B9, and B10, as reference gray-scale voltages V0, V1, . . . , V8, and V9. Each of accompanied letters R, G, and B added to the voltages output from the voltage dividing circuits DR, DG, and DB represents a voltage for each of the R, G, and B colors. Each of the MPXs M1, M2, . . . , M9, and M10 selects a corresponding voltage in response to the selection control signal SL being output in synchronization with the selection of the scanning line 21 for each of the R, G, and B colors and outputs it as the reference gray-scale voltage to the signal line driving circuit 6. In the example shown in FIG. 3, only ten pieces of the reference gray-scale voltages are input to the signal line driving circuit 6, however, in order to perform the exact gamma correction, the larger the number of the reference gray-scale voltages the better.

In the signal line driving circuit 6, the MPX 61 divides the reference gray-scale voltages V0 to V9 into a set of V0 to V4 and a set of V5 to V9 and outputs them to a DAC 62. Moreover, the gray-scale data being fed from the display control circuit 3, for example, 6 bits of gray-scale data D1, D2, and D3 are held in parallel by the data register section 64 which is controlled by an output at each stage in a shift register section 63 that is controlled by a horizontal start pulse HSP and a clock signal HCK. The signals making up gray-scale data D1, D2, and D3 being held in parallel in the data register section 64 are collectively transferred by a latch signal STB to a latch section 65 and latched therein. Gray-scale data D1, D2, and D3 being latched in the latch section 65 are transferred through a level shift section 66 to the DAC 62. Gray-scale data D1, D2, and D3 having been transferred to the DAC 62 undergo the gamma correction based on the set of the reference gray-scale voltages V0 to V4 and the set of the reference gray-scale voltages V5 to V9 fed from the MPX 61 and, at the same time, causes a D-A converted signal voltage to be generated which is output through the voltage followers F1, F2, . . . , F639, and F640 to each of the corresponding signal lines 22. The gray-scale data for the R color, gray-scale data for the G color, and gray-scale data for the B color, all being fed from the display control circuit 3, are sequentially switched in a repeated manner in every scanning position, as shown in FIG. 2. Moreover, in this example, Gray-scale data D1, D2, and D3 are transferred to the data register section 64 of the signal line driving circuit 6 through three ports, as shown in FIG. 3, however, a number of ports are not limited and any number of ports can be used.

Next, operations of the LCD 1 of the first embodiment will be explained by referring to FIG. 1 to FIG. 5.

Figure 10:
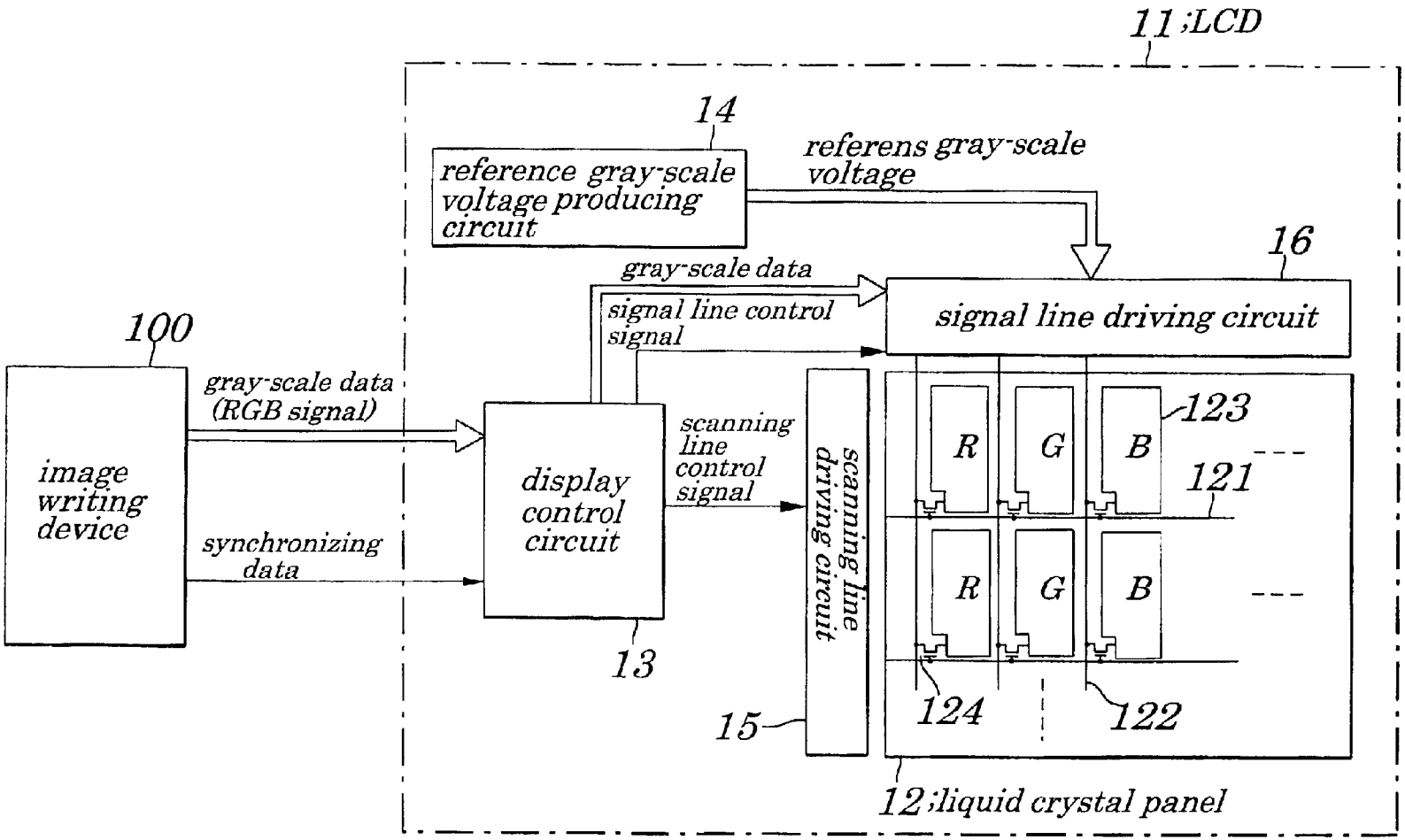
FIG.10 (PRIOR ART)
FIG. 10 is a schematic block diagram showing a first example of a conventional LCD.
Figure 11:
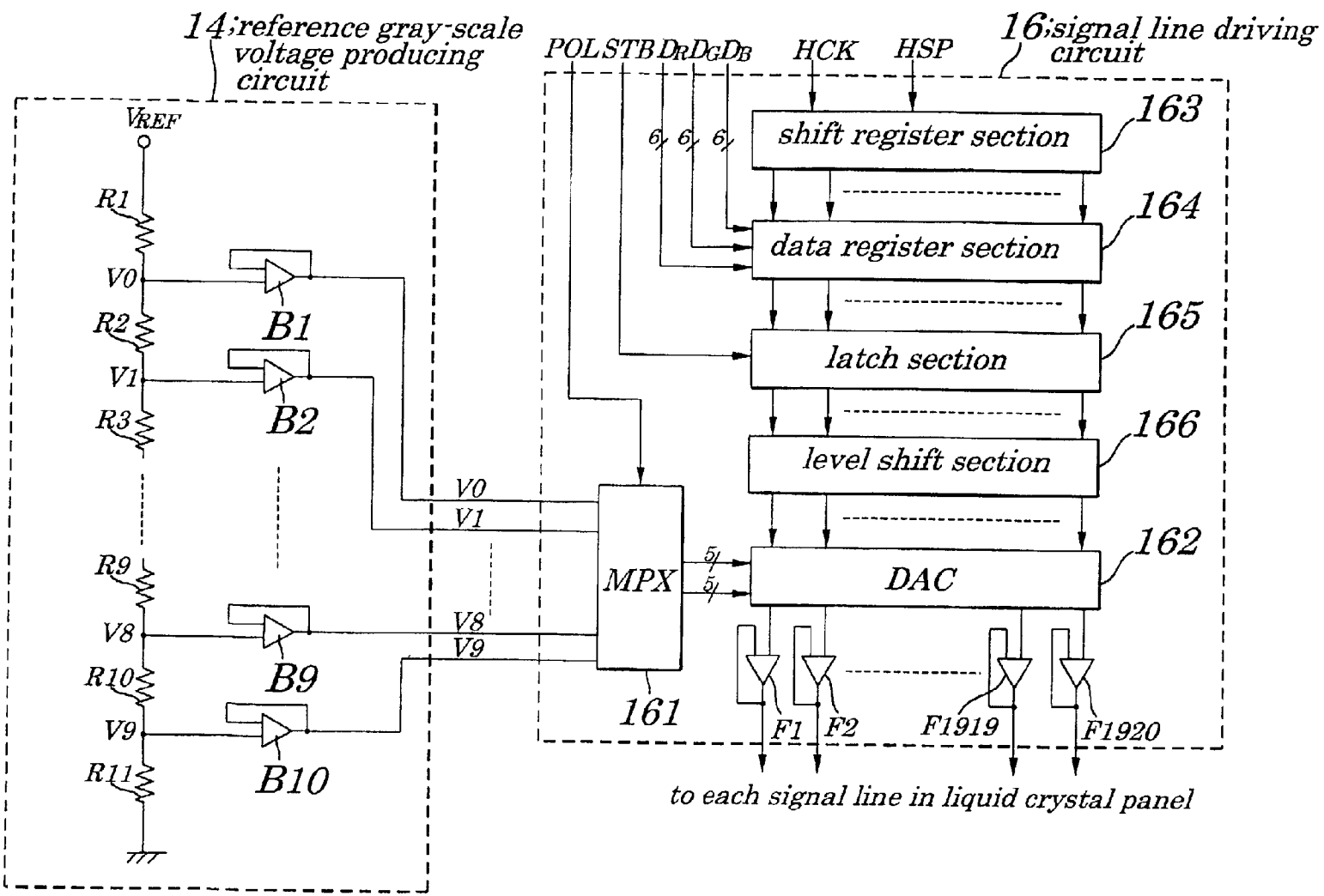
FIG. 11 (PRIOR ART)
FIG. 11 is a schematic block diagram showing an example of configurations of a reference gray-scale voltage producing circuit and a signal line driving circuit employed in the conventional LCD.
Figure 12:
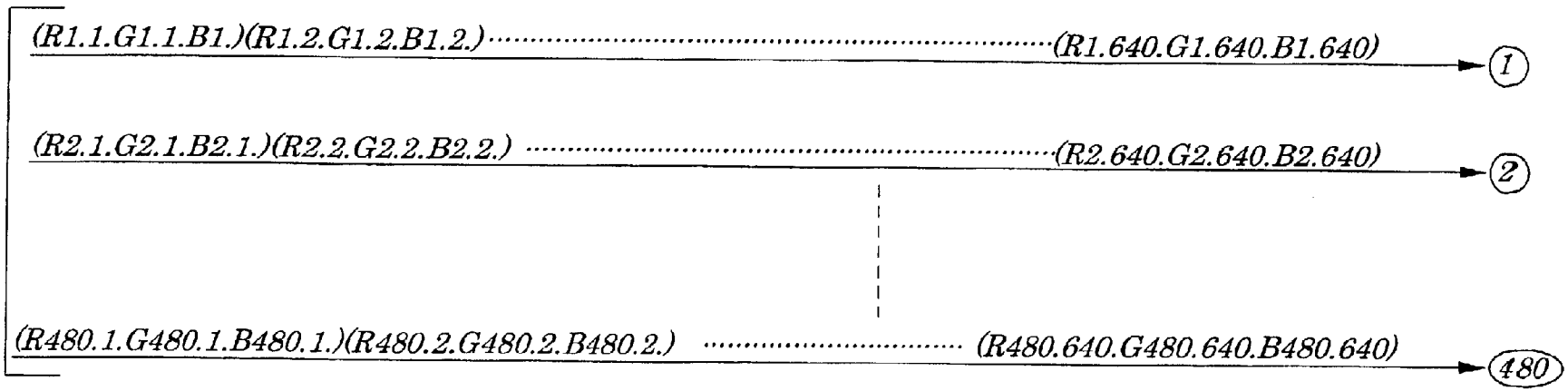
FIG. 12 (PRIOR ART)
FIG. 12 is a diagram illustrating a gray-scale data input for an LCD.
Figure 13:
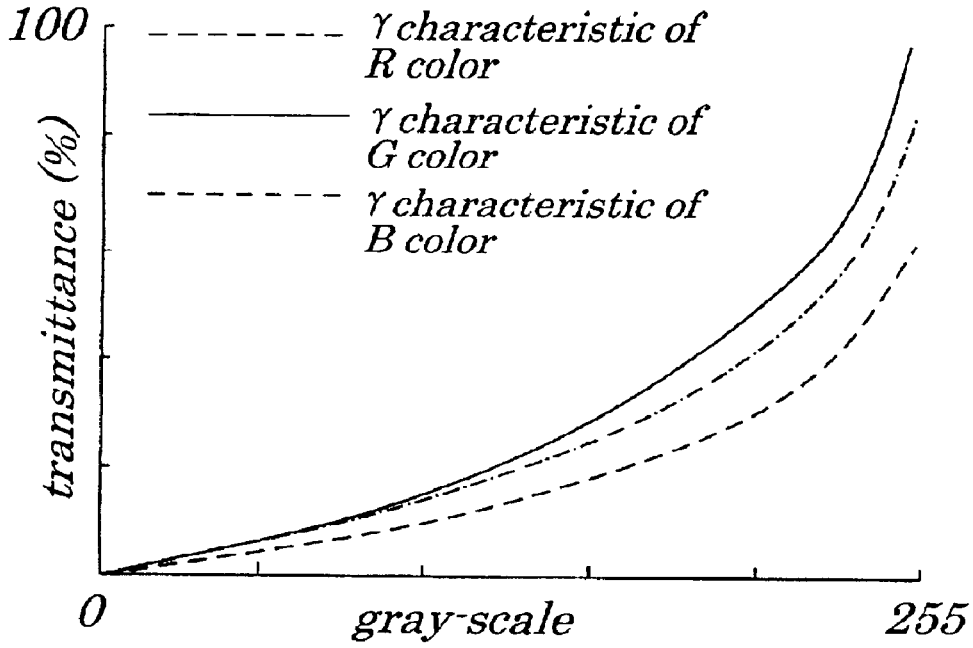
FIG. 13 (PRIOR ART)
FIG. 13 is a diagram showing an example of gamma characteristics in a liquid crystal panel.
Figure 14:
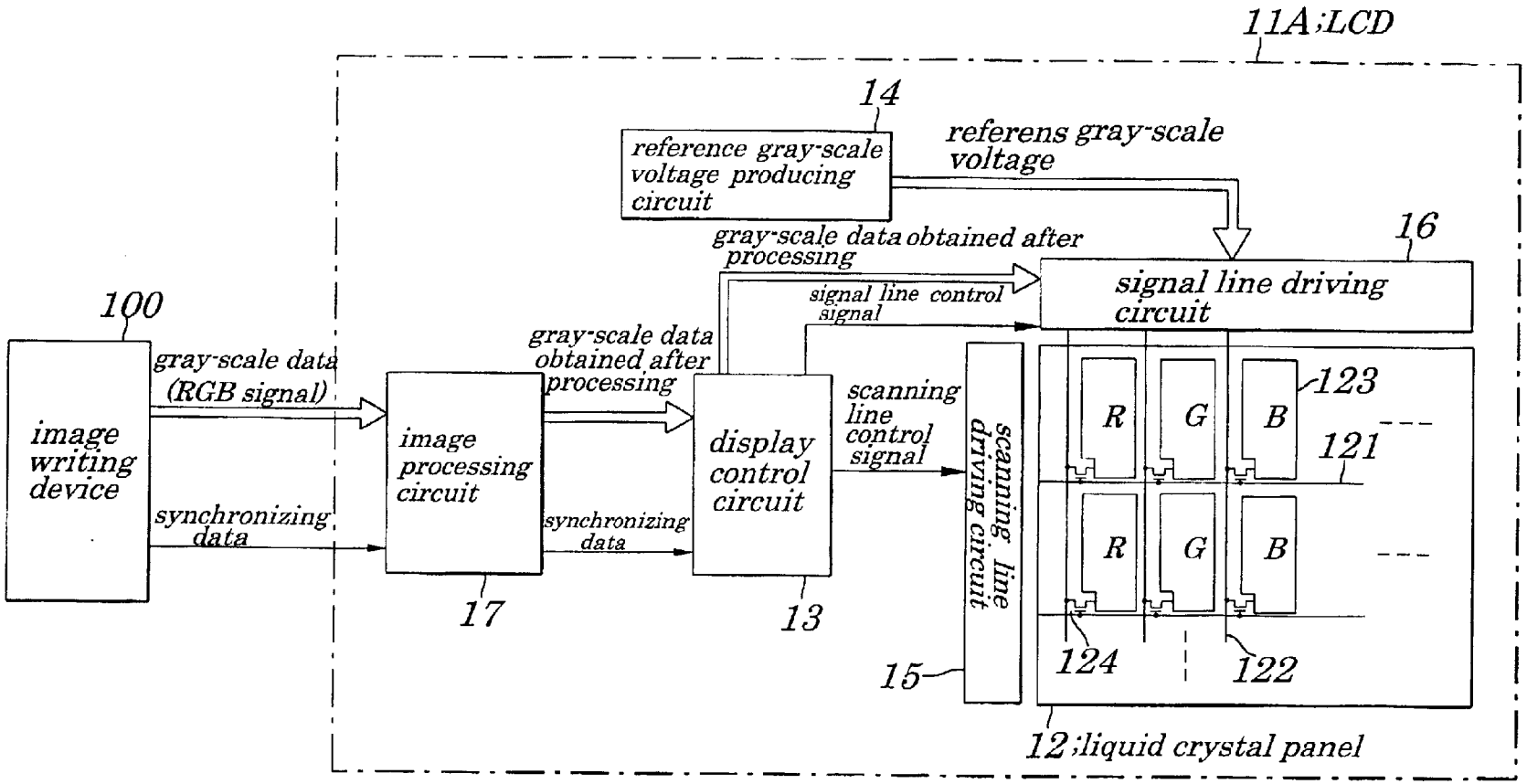
FIG.14(PRIOR ART)
FIG. 14 is a schematic block diagram showing configurations of another LCD as a second conventional example.

The image writing device 100 made up of a personal computer or a like, as in the case shown in FIG. 10 (prior art), outputs, for example, gray-scale data of 64 gray levels and synchronizing data of 64 gray levels. In the LCD 1, the display control circuit 3 sorts, as shown in FIG. 2, gray-scale data according to the input gray-scale data made up of signals in which data for the R, G, and B colors are arranged in a repeated manner, fed from the image writing device 100 and according to synchronizing data in every scanning line position in a manner so as to correspond to an arrangement of pixels in the liquid crystal panel 2 and outputs it to the signal line driving circuit 6 and, at the same time, outputs, according to the synchronizing data, a scanning line control signal to the scanning line driving circuit 5 and a signal line control signal to the signal line driving circuit 6.

This causes the scanning line driving circuit 5 to sequentially output a scanning signal required to form a screen in every field to each of the scanning lines 21 according to a scanning line control signal and therefore the TFT 24 being connected to each of the scanning lines 21 is turned ON and a signal voltage is fed to each of the pixel electrodes 23 being connected to the scanning lines 21 from each of the signal lines 22. Moreover, the signal line driving circuit 6 produces a signal to which a gamma correction is performed so that a V-T characteristic value of each color in the liquid crystal panel 2 becomes a specified gamma value by using a reference gray-scale voltage of each of the R, G, and B colors fed from the RGB switching reference gray-scale voltage producing circuit 4 in every scanning period and outputs it to each signal line 22 in the liquid crystal panel 2.

In the LCD 1, since the pixels are so arranged that each of the pixels being connected to each of the scanning lines 21 in the liquid crystal panel 2 has a same color, the number of the signal lines 22 in the liquid crystal panel 2 is one third the number of the signal lines 122 in the conventional liquid crystal panel 12 and the number of the scanning lines 21 are larger by three times than that used in the conventional liquid crystal panel 12. Therefore, the display control circuit 3 sorts gray-scale data so as to respond to arrangement of the signal line 22 and scanning line 21, as shown in FIG. 2, and the scanning line driving circuit 5, in order to correspond to the sorted gray-scale data, by switching the scanning line 21 at a speed being higher by three times than that in the conventional example, scans one color pixel existing in a vertical direction individually for each of the R, G, and B colors. In the signal line driving circuit 6, since the number of the signal lines 22 becomes one-third the number of the signal lines 122 (prior art), the gray-scale data being transferred from the display control circuit 3 in one scanning period becomes one-third that in the conventional example and the gray-scale data are input for each of the R, G, and B colors. Moreover, a scale of each of the shift register section 63, data register 64, latch section 65, level shift section 66, voltage followers B1 to B10 or a like becomes one-third that in the conventional example.

At this point, as shown in FIG. 4, the RGB switching reference gray-scale producing circuit 4 produces a reference gray-scale voltage for the R color, a reference gray-scale voltage for the G color, and a reference gray-scale voltage for the B color, all being produced so as to match the V-T characteristic value of each of the R, G, and B colors of a liquid crystal panel 2, and feeds them to the signal line driving circuit 6 which switches a reference gray-scale voltage required when a signal line voltage to be fed to the liquid crystal panel 2 is generated according to gray-scale data of each color for each of the R, G, and B colors. Therefore, since such data processing as performed in the conventional example is not required when the gamma correction is made by the signal line driving circuit 6 to the input gray-scale data and when a signal line voltage is produced by the signal line driving circuit 6, unlike in the conventional example, no decrease in the number of gray levels in an output image occurs and, as shown in FIG. 5, there is matching in the gamma characteristic of each of the R, G, and B colors and, as a result, no lowering of an image quality caused by the gamma correction occurs.

Thus, according to the LCD 1 of the first embodiment, since the gamma correction is made to gray-scale data being input by using a reference gray-scale voltage for each of the R, G, and B colors being matched with a V-T characteristic of a liquid crystal panel 2 and a signal line voltage to be fed to the liquid crystal panel 2 is generated, no decrease in a number of gray levels in an output image occurs when the gamma correction is made and therefore lowering in an image quality caused by the gamma correction can be prevented.

Second Embodiment

Figure 6:
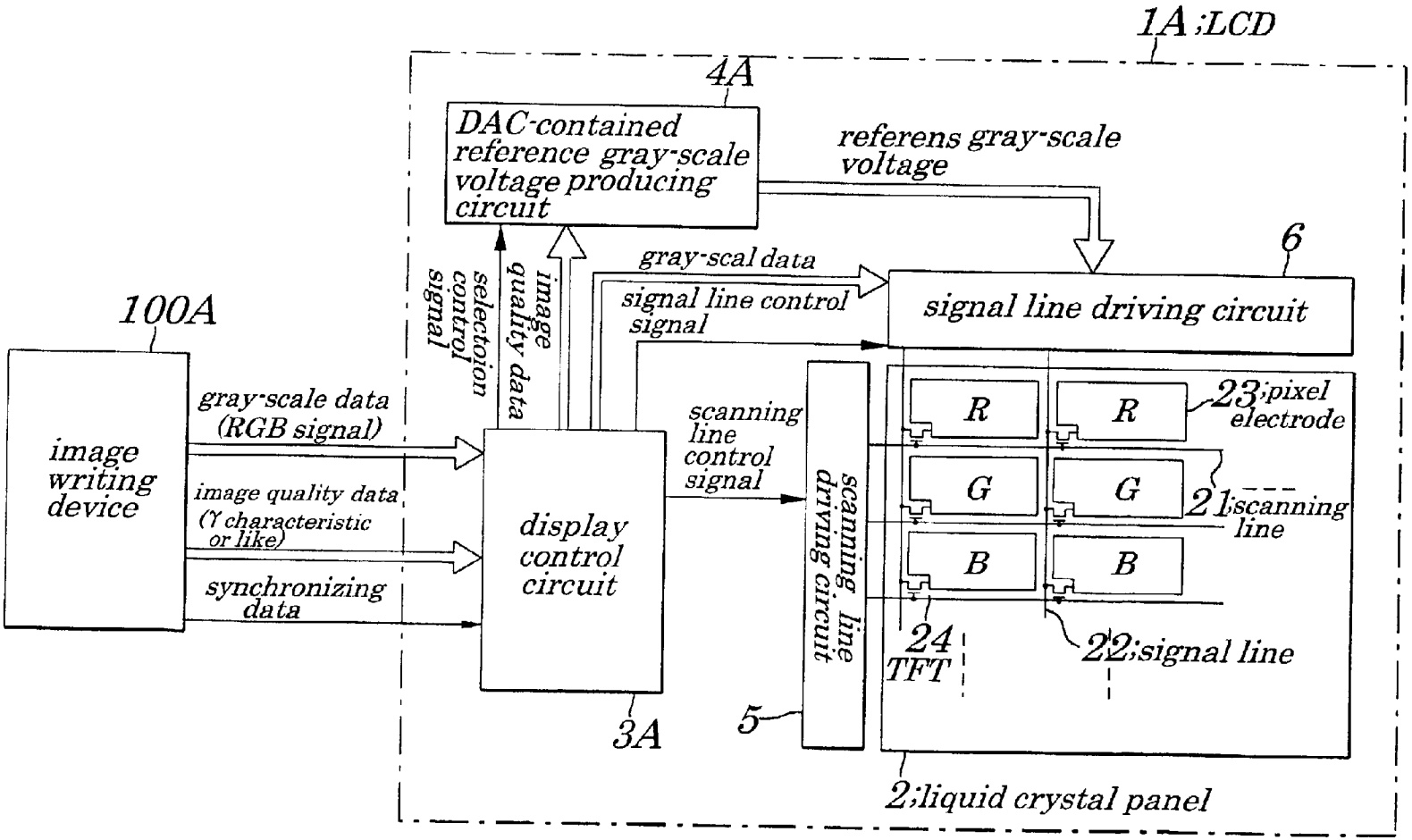
FIG. 6 is a schematic block diagram showing configurations of an LCD according to a second embodiment of the present invention.
Figure 7:
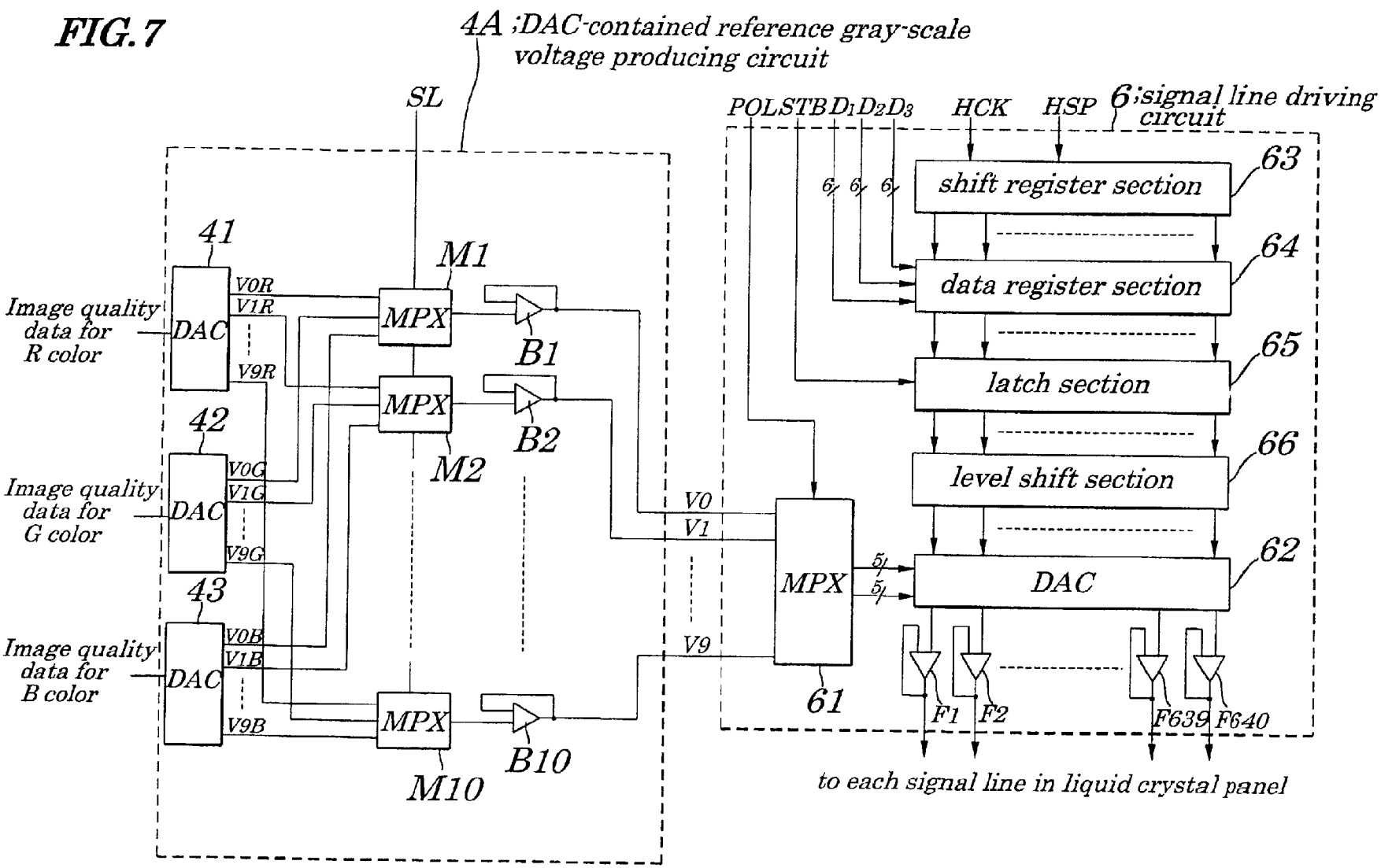
FIG. 7 is a schematic block diagram showing a concrete example of configurations of a reference gray-scale voltage producing circuit and a signal line driving circuit according to the second embodiment of the present invention.

FIG. 6 is a schematic block diagram showing configurations of an LCD 1A according to a second embodiment of the present invention. FIG. 7 is a schematic block diagram showing a concrete example of configurations of a DAC-contained reference gray-scale voltage producing circuit 4A, a scanning reference gray-scale voltage producing circuit 4A and a signal line driving circuit 6 according to the second embodiment.

The LCD 1A of the second embodiment, as shown in FIG. 6, chiefly includes a liquid crystal panel 2 a display control circuit 3A, the DAC-contained reference gray-scale voltage producing circuit 4A, a scanning line driving circuit 5, and the signal line driving circuit 6. Configurations of the liquid crystal panel 2, scanning line driving circuit 5, and signal line driving circuit 6 are same as those in the first embodiment shown in FIG. 1 and descriptions of them are omitted accordingly.

In the second embodiment, an image writing device 100A outputs, in addition to gray-scale data for R, G, and B colors and synchronizing data output by the image writing device 100 in the first embodiment, image quality data of each image signal for each of R, G, and B colors. Moreover, in the embodiment, an example is described in which the image quality data is output in a form of a digital value inhibiting a gamma characteristic of an image output from the image writing device 100A.

In the conventional LCD 11 shown in FIG. 10, the data to be transferred from the image writing device to the LCD 11 is only gray-scale data; and synchronizing data and image quality data are not transferred and contents of gamma correction processing are determined in advance by a reference gray-scale voltage producing circuit 14 and by a signal line driving circuit 16. Therefore, a problem occurs in that, when a V-T characteristic of a liquid crystal panel 12 is different in every LCD 11, even if same input image signal is used, an image on a screen is seen differently. In the LCD 1A of the second embodiment, the above problem is solved by positively changing a reference gray-scale voltage for each of the R, G, B colors according to image quality data.

As shown in FIG. 6, the display control circuit 3A sorts each of gray-scale data made up of signals for the R, G, and B colors fed from the image writing device 100A according to synchronizing data for every scanning line 21 in a manner so as to correspond to arrangement of pixels in the liquid crystal panel 2 and outputs the sorted gray-scale data to the signal line driving circuit 6. The display control circuit 3A also outputs a scanning line control signal to the scanning line driving circuit 5 according to synchronizing data and a signal line control signal to the signal line driving circuit 6 and image quality data fed from the image writing device 100A to the DAC-contained reference gray-scale voltage producing circuit 4A.

The DAC-contained reference gray-scale voltage producing circuit 4A converts digital values of the image quality data into analog values and outputs three kinds of reference gray-scale voltages including a reference gray-scale voltage for the R color, a reference gray-scale voltage for the G color and a reference gray-scale voltage for the B color, each being matched with each of the R, G, and B colors of the liquid crystal panel 2 which is required when a signal having a voltage corresponding to gray-scale data is output by the signal line driving circuit 6 to each signal line 22.

The DAC-contained reference gray-scale voltage producing circuit 4A, as shown in FIG. 7, has digital-analog converters (DAC) 41, 42, and 43 each corresponding to each of the R, G, and B colors, multiplexers (MPX) M1, M2, . . . , M10, and voltage followers B1, B2, . . . , B10.

Each of the DACs 41, 42, and 43 performs a digital-analog conversion on image quality data for the R color, for the G color, and for the B color, each being image quality data corresponding to gray-scale data for each of the R, G, and B colors input from the image writing device 100A and outputs reference gray-scale voltages V0R, V1R, . . . , V9R, V0G, V1G, . . . , V9G, V0B, V1B, . . . , and V9B each corresponding to each of the R, G, and B colors which has been gamma-corrected according to the image quality data. Each of MPXs M1, M2, . . . , M10 selects the reference gray-scale voltage fed from each of the DACs 41, 42, and 43 for each of the R, G, and B colors in response to a selection control signal SL and outputs through each of the voltage followers B1, B2, . . . , B10 as reference gray-scale voltages V0, V1, . . . , V8, and V9. Moreover, in FIG. 7, the reference gray-scale voltages V0, V1, . . . , V8, and V9 are input to the signal line driving circuit 6 through ten ports, however, it is preferable that the number of the reference gray-scale voltages is larger, in order to perform the exact gamma correction.

In the LCD 1A shown in FIG. 6, when each of the signal lines 22 is driven by the signal line driving circuit 6, the DAC-contained reference gray-scale voltage producing circuit 4A produces reference gray-scale voltages for the R color, G color, and B color in a manner that each of the reference gray-scale voltages is matched with a V-T characteristic value for each of the R, G, and B colors of the liquid crystal panel 2 and with an image quality of an input image signal and feeds them to the signal line driving circuit 6. The signal line driving circuit 6 produces a signal line voltage to be fed to the liquid crystal panel 2 by using gray-scale data for each of the R, G, and B colors to be switched in every scanning line position and reference gray-scale data for each of the R, G, and B colors fed from the DAC-contained reference gray-scale voltage producing circuit 4A.

Therefore, when the signal line driving circuit 6 produces a signal line voltage by making a gamma correction according to gray-scale data being input, since, unlike in the case of the conventional example, the data processing to the gray-scale data being input is not required, it is made possible to positively correct a gamma characteristic for each of the R, G, and B colors without causing a decrease in the number of gray levels in an output image.

Thus, according to the LCD 1A of the second embodiment, the gamma correction to gray-scale data being input is made by using a reference gray-scale voltage for each of the R, G, and B colors being matched with a V-T characteristic value of a liquid crystal panel 2 and, when a signal line voltage to be fed to the liquid crystal panel 2 is produced, a gamma correction is made according to a quality of an image being input and therefore the number of gray levels in an output image does not decrease when the gamma correction is made and it is possible to prevent the decrease in an image quality in an output image caused by the gamma correction and to make a correction to a quality of an image being input.

Third Embodiment

Figure 8:
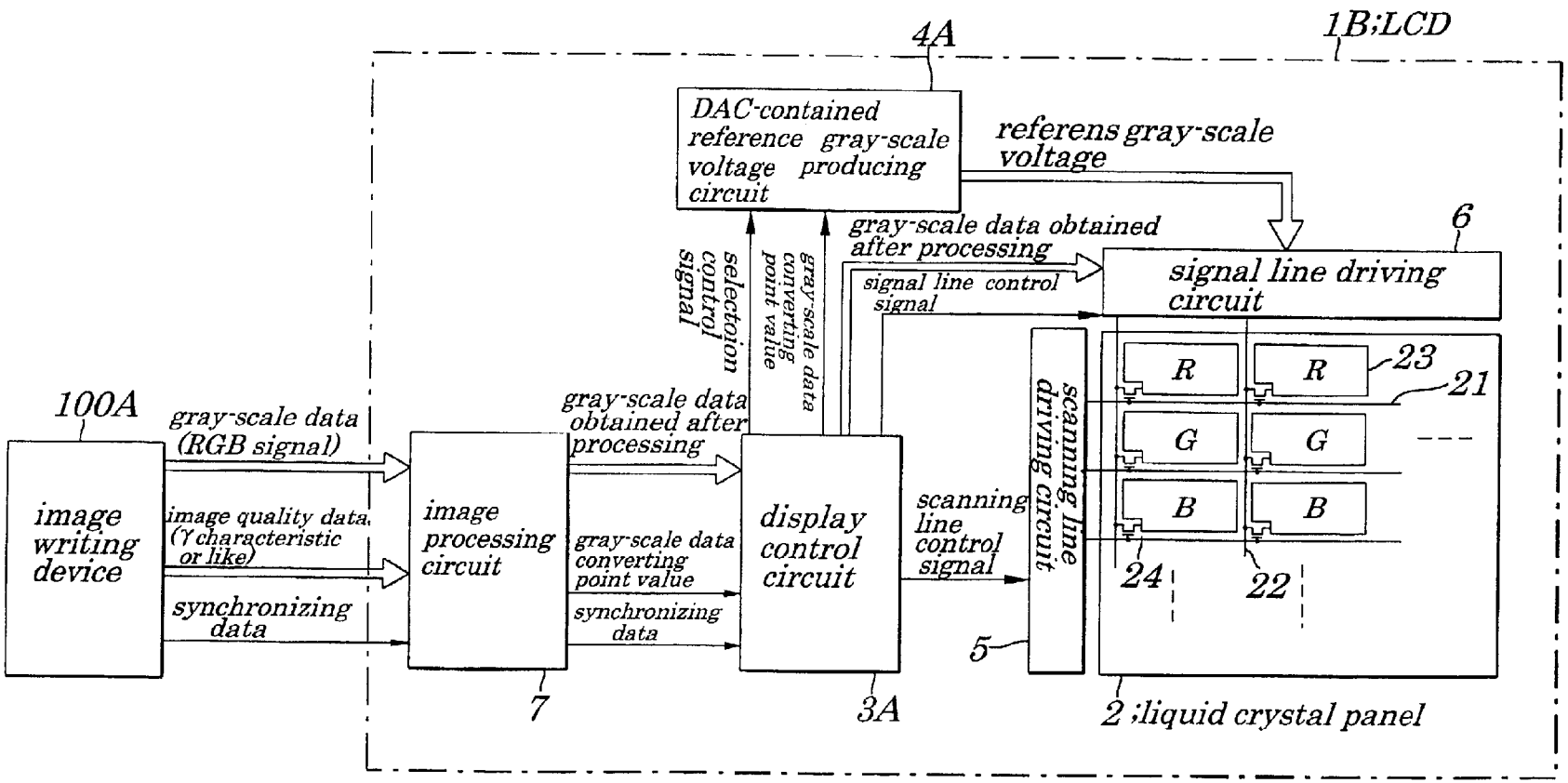
FIG. 8 is a schematic block diagram showing configurations of an LCD according to a third embodiment of the present invention.
Figure 9:
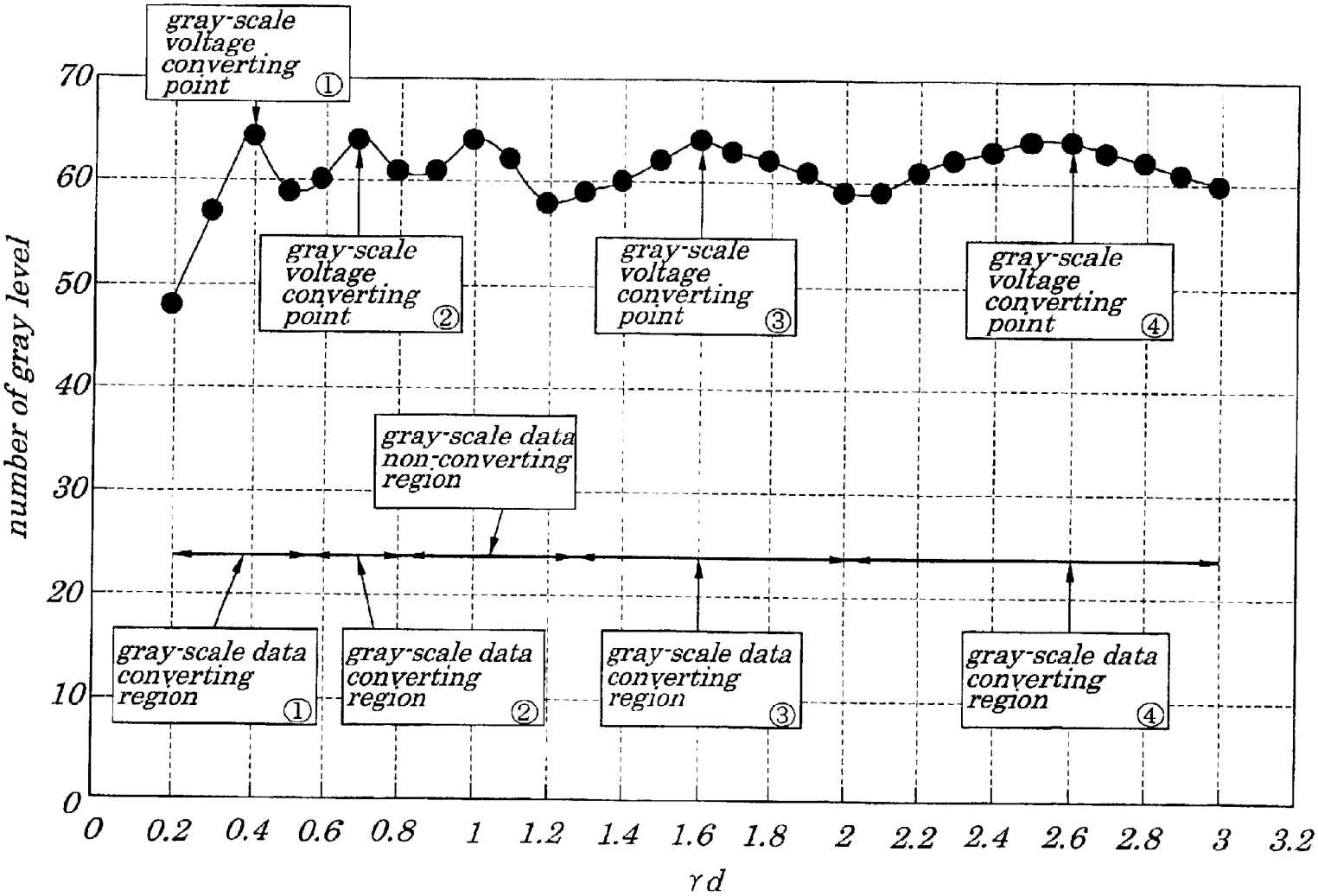
FIG. 9 is a diagram illustrating a decrease in a number of gray levels in an output image caused by a gamma correction in the third embodiment.

FIG. 8 is a schematic block diagram showing configurations of an LCD 1B according to a third embodiment of the present invention. FIG. 9 is a diagram illustrating a decrease in a number of gray levels in an output image caused by a gamma correction in the third embodiment.

The LCD 1B of the third embodiment, as shown in FIG. 8, chiefly includes a liquid crystal panel 2, a display control circuit 3A, a DAC-contained reference gray-scale voltage producing circuit 4A, a scanning line driving circuit 5, a signal line driving circuit 6, and an image processing circuit 7. Configurations of the liquid crystal panel 2, display control circuit 3A, scanning line driving circuit 5, and signal line driving circuit 6 are same as those in the second embodiment shown in FIG. 7 and detailed descriptions are omitted accordingly.

In the case where a range of the gamma correction is wide such as a range for a gamma correction (0.20 to 3.00) in a property on a screen of Windows, a reference gray-scale voltage at each gamma value has to be set in advance in order to make a correction by a setting method of a reference gray-scale voltage shown in the second embodiment and, therefore, enormous circuit configurations and adjustment work are required. To solve this problem, in the third embodiment, in addition to configurations in the second embodiment, the image processing circuit 7 is provided in a stage before the display control circuit 3.

The image processing circuit 7 is made up of a look-up table (LUT) for the R signal, a look-up table (LUT) for the G signal, and a look-up table (LUT) for the B signal and makes a gamma correction to gray-scale data for each of R, G, and B colors by data processing and outputs gray-scale data obtained after processing and outputs gray-scale data converting point value obtained from the image quality data.

In the LCD 1B shown in FIG. 8, the image processing circuit 7 performs data processing to gray-scale data for each of the R. G, and B colors fed from an image writing device 100A according to image quality data also fed from the image writing device 100 A and then transmits data-processed gray-scale date to the display control circuit 3A.

At this point, in the image processing circuit 7, the gray-scale data converting points corresponding to a plurality of gamma values is set in advance within a range of the gamma values that can be corrected and then the input image quality data is compared with gamma values set in advance and data processing is performed separately when the input image quality data matches any one of the plurality of the gamma values being set in advance and when the input image quality data matches any one of the plurality of the gamma values being set in advance.

When the input image quality data matches any one of the plurality of gamma values, gray-scale data being same as the input gray-scale data is output to the display control circuit 3A and a gray-scale data converting point value corresponding to the gamma value being matched with the input image quality data is output. In the DAC-contained reference gray-scale voltage producing circuit 4A, setting is made so that a reference gray-scale voltage corresponding to a gamma value of the gray-scale data converting point is generated. Each of the reference gray-scale voltages for the R, G, and B colors is changed according to the gray-scale data converting point value being transferred from the display control circuit 3A. The reference gray-scale voltages for the R color, the G color and the B color having been changed according to gray-scale data converting point value are switched according to a selection control signal SL being output in synchronization with a selection of a scanning line and are then output to the signal line driving circuit 6. When the input image quality data matches any one of a plurality of gamma values being set in advance, as in the case of the second embodiment, processing of the gamma correction is made possible without a decrease in the number of gray levels in an output image.

On the other hand, if the input image quality data does not match any one of the plurality of gamma values set in advance, a gray-scale data converting point being nearest to a gamma value of the input image quality data is selected out of the gray-scale data converting points corresponding to the plurality of gamma values set in advance and gray-scale data obtained by performing data processing according to the selected gray-scale data converting point is output to the display control circuit 3A and the selected gray-scale data converting point value is output.

In this case, the processing on gray-scale data at each of the gray-scale data converting points is performed by following equation, for example, when gray level data are made up of 64 gradations:

$$Dout = INT\ \{64 \times (Din/64)\hat{}(1/\gamma d')\} \quad (2)$$

where "Din" denotes input gray-scale data, "Dout" denotes output gray-scale data, "γd'" denotes (targeted γd)/(γd at gray-scale voltage converting point), "INT" denotes a symbol to make values be an integer, and "^" denotes a power.

In the DAC-contained reference gray-scale voltage producing circuit 4A, as in the case where the input image quality data matches a plurality of gamma values, the reference gray-scale voltage for each of the R, G, and B colors is changed according to the gray-scale data converting point value being transferred from the display control circuit 3A and the reference gray-scale voltages for the R color, the G color and the B color changed according to the gray-scale data converting point value are switched in response to a selection control signal S1 and are output to the signal line driving circuit 6.

Figure 15:
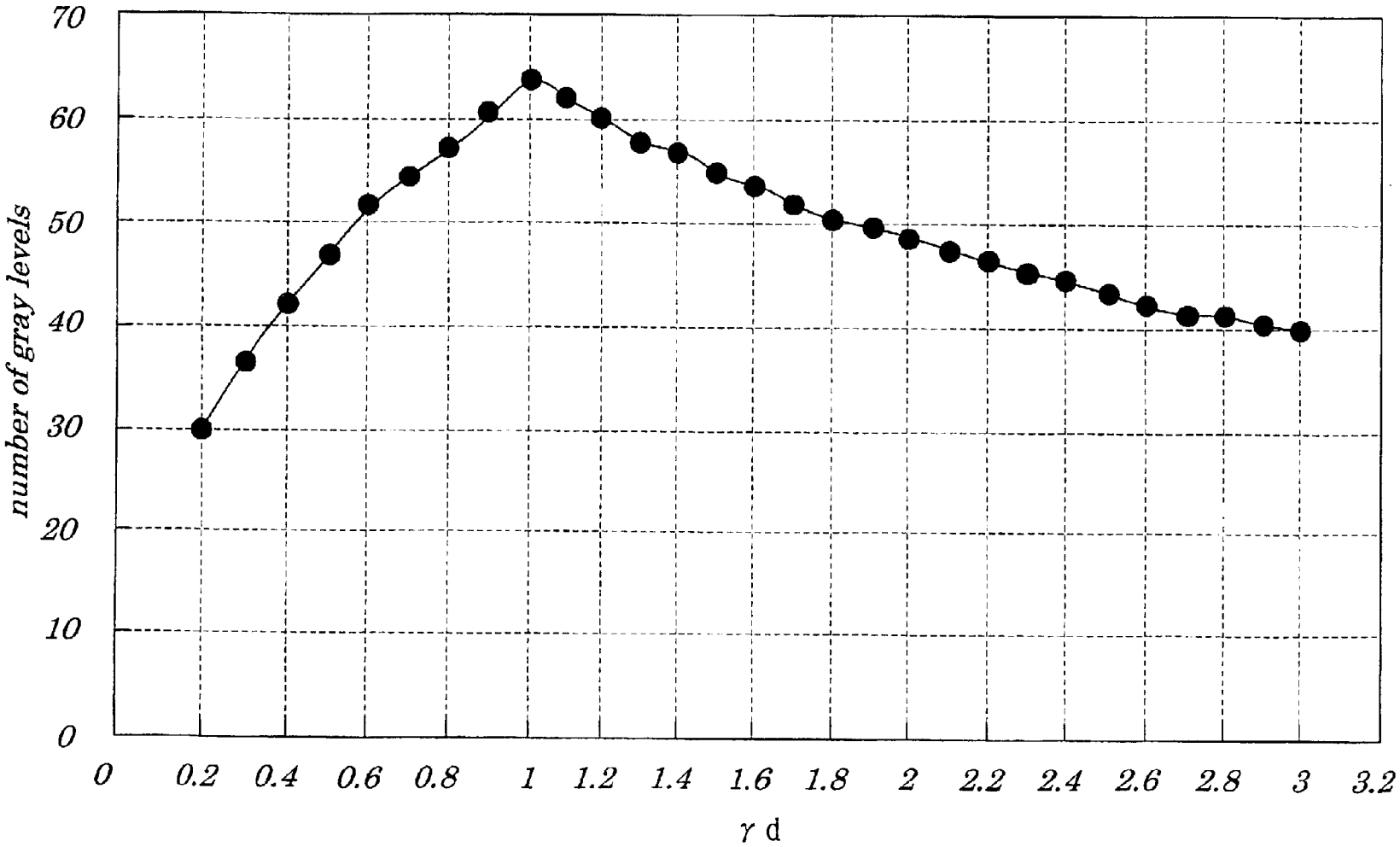
FIG.15(PRIOR ART)
FIG. 15 is a diagram illustrating an decrease in a number of gray levels based on a gamma correction in the LCD of the second conventional example.

FIG. 9 illustrates a decrease in the number of gray levels in an output image caused by gray-scale data conversion. For example, even if a gamma value "γd" of image quality data fed from the image writing device 100A is 2.4, the number of gray levels is about sixty-three obtained when a reference gray-scale voltage at a gray-scale voltage converting point ④ (γd=2.6) is used, which shows a smaller decrease compared with the conventional case shown in FIG. 15 in which only data processing is performed.

Thus, in the LCD 1B of the third embodiment, the range in which a gamma correction can be made is divided into a plurality of converting regions and data processing is performed according to a degree to which each of the plurality of converting regions is placed far from the gray-scale data conversion point being set in the region to perform gray-scale data processing. Therefore, a wide gamma correction range is provided by comparatively simple configurations and a decrease in the number of gray levels in an output image can be prevented.

It is apparent that the present invention is not limited to the above embodiments but may be changed and modified without departing from the scope and spirit of the invention. For example, in the above second embodiment, a gamma value is used as image quality data, however, luminance of a backlight may be controlled on a side of an LCD by transmitting information about luminance of the backlight or contrast of an image to be displayed may be controlled on a side of the LCD by transmitting information about the contrast.

What is claimed is:

1. A liquid crystal display comprising:

a liquid crystal panel in which pixel electrodes for each of red, green, and blue colors are arranged sequentially and repeatedly on a screen along a scanning line on a same row;

a scanning line driving unit to sequentially perform scanning along said scanning line on each row in every scanning period;

a reference gray-scale voltage producing unit to produce a reference gray-scale voltage which corresponds to a voltage-transmittance characteristic curve for each of said red, green, and blue colors to be displayed in said liquid crystal panel at every time of scanning along said scanning line for each of said red, green, and blue colors; and a signal line driving unit to make a gamma correction to input gray-scale data corresponding to each color by using said reference gray-scale voltage for each of said red, green, and blue colors and to produce a signal voltage and then to feed said produced signal voltage to a signal line on a column corresponding to said pixel electrode for each of said red, green, and blue colors.

2. The liquid crystal display according to claim 1, wherein said input gray-scale data is obtained by sorting outside gray-scale data in which gray-scale data for each of said red, green, and blue colors is arranged along said signal line on each column and is transmitted sequentially and repeatedly for every scanning line by a display control unit so that gray-scale data for each of said red, green, and blue colors is arranged along said same scanning line and is transmitted sequentially and repeatedly for every scanning line.

3. The liquid crystal display according to claim 1, wherein said reference gray-scale voltage producing unit has a voltage dividing unit for each of said red, green, and blue colors to divide a reference voltage and produces a voltage used to make a gamma correction so as to correspond to a voltage-transmittance characteristic of each of said red, green, and blue colors in said liquid crystal panel from said voltage dividing unit for each of said red, green, and blue colors and outputs said produced voltage as said reference gray-scale voltage for each of said red, green, and blue colors at every scanning along each scanning line for each of said red, green, and blue colors.

4. The liquid crystal display according to claim 1, wherein said reference gray-scale voltage producing unit changes a reference gray-scale voltage for each of said red, green, and blue colors according to image quality data of an input image.

5. The liquid crystal display according to claim 4, wherein said reference gray-scale voltage producing unit has a digital-analog converting section for each of said red, green, and blue colors to perform a digital-analog conversion on image quality data exhibiting a gamma characteristic of an input image and to generate a reference gray-scale voltage in which a change in gamma characteristics of said input image has been compensated for and a selecting section to select said reference gray-scale voltage for each of said red, green, and blue colors generated by said digital-analog converting section at every scanning performed on said scanning line for each of said red, green, and blue color and to output said selected reference gray-scale voltage.

6. The liquid crystal display according to claim 1, further comprising an image processing unit to obtain output gray-scale data from input gray-scale data, and wherein said reference gray-scale voltage producing unit produces a reference gray-scale voltage for each of said red, green, and blue colors so as to correspond to a gamma value at a plurality of gray-scale voltage converting points within a range in which said gamma correction is made possible and wherein said signal line driving unit makes a gamma correction to input gray-scale data using said reference gray-scale voltage at said gray-scale voltage converting point and makes said gamma correction, in the case of a gamma value at an intermediate point between said gray-scale voltage converting points being adjacent to each other, to said input gray-scale data according to output gray-scale data obtained by said image processing unit from input gray-scale data based on a relation between a gamma value at said gray-scale voltage converting points being nearest to a gamma value at said intermediate point and said gamma value at said intermediate point by using said reference gray-scale voltage at said gray-scale voltage converting point.

7. A method for driving a liquid crystal display having a liquid crystal panel in which pixel electrodes for each of red, green, and blue colors are arranged sequentially and repeatedly in a manner so as to correspond to each of scanning lines on a same row, said method comprising:

a step of scanning along each of said scanning lines on each row in every scanning period;

a step of producing a reference gray-scale voltage corresponding to a voltage-transmittance characteristic of each of said red, green, and blue colors of said liquid crystal panel at every scanning along said signal line for each of said red, green, and blue colors;

a step of making a gamma correction to input gray-scale data corresponding to each of said red, green, and blue colors by using said reference gray-scale voltage for each of said red, green, and blue colors and producing a signal voltage; and a step of feeding said signal voltage to a signal line on each column corresponding to a pixel electrode of each of said red, green, and blue colors in every scanning period.

8. The method for driving the liquid crystal display according to claim 7, wherein said reference gray-scale voltage of each of said red, green, and blue colors is changed according to image quality data of an input image.

9. The method for driving the liquid crystal display according to claim 7, further comprising:

a step of producing a reference gray-scale voltage of each of said red, green, and blue colors corresponding to a gamma value at a plurality of gray-scale voltage converting points in a range in which a gamma correction is made possible;

a step of making said gamma correction to input gray-scale data by using said reference gray-scale voltage at said gray-scale voltage converting points; and a step of making said gamma correction to input gray-scale data, in the case of a gamma value at an intermediate point between said gray-scale voltage converting points being adjacent to each other by using said reference gray-scale voltage at said gray-scale voltage converting points according to output gray-scale data obtained from said input gray-scale data based on a relation between a gamma value at said gray-scale voltage converting point being nearest to said gamma value at said intermediate point and said gamma value at said intermediate point.

* * * * *